US005697036A

United States Patent [19]

Moser

[11] Patent Number: 5,697,036

[45] Date of Patent: Dec. 9, 1997

[54] SINGLE ROLL RAM SYSTEM

[75] Inventor: Rabin Moser, Victor, N.Y.

[73] Assignee: Xerox Corporation, Stamford, Conn.

[21] Appl. No.: 689,615

[22] Filed: Aug. 12, 1996

[51] Int. Cl.[6] ..... G03G 15/20

[52] U.S. Cl. ..... 399/329; 118/60; 219/216; 399/325; 399/328

[58] Field of Search ..... 399/320, 322, 399/323, 324, 325, 328, 329, 330, 335, 338; 219/216; 118/60

[56] References Cited

U.S. PATENT DOCUMENTS

| | | | |
|---|---|---|---|
| 3,716,018 | 2/1973 | Ohta et al. | 118/60 X |
| 3,716,221 | 2/1973 | Gorka et al. | 118/60 |
| 4,214,549 | 7/1980 | Moser | 118/60 |
| 4,397,936 | 8/1983 | Sakata et al. | 430/124 |
| 4,512,650 | 4/1985 | Kocher | 399/325 |
| 4,770,116 | 9/1988 | Moser | 118/60 |
| 5,268,559 | 12/1993 | Jacobs | 219/216 |
| 5,345,300 | 9/1994 | Uehara et al. | 399/329 |
| 5,359,401 | 10/1994 | Uehara et al. | 219/216 X |
| 5,465,146 | 11/1995 | Higashi et al. | 399/328 |
| 5,621,512 | 4/1997 | Uehara et al. | 399/328 |

*Primary Examiner*—Sandra L. Brase

[57] ABSTRACT

A self-stripping heat and pressure fuser and Release Agent Management (RAM) system therefor. A fusing belt entrained about a heated fuser roll and a support roller is move at a first predetermined speed via the heated fuser roll and at a second speed via the support roll. The support roll drives the belt at a speed 5% greater than the speed at which is driven by the fuser roll. Thus, the belt is overdriven such that it is stretched whereby substrates carrying heated toner images are stripped from the fusing belt.

9 Claims, 1 Drawing Sheet

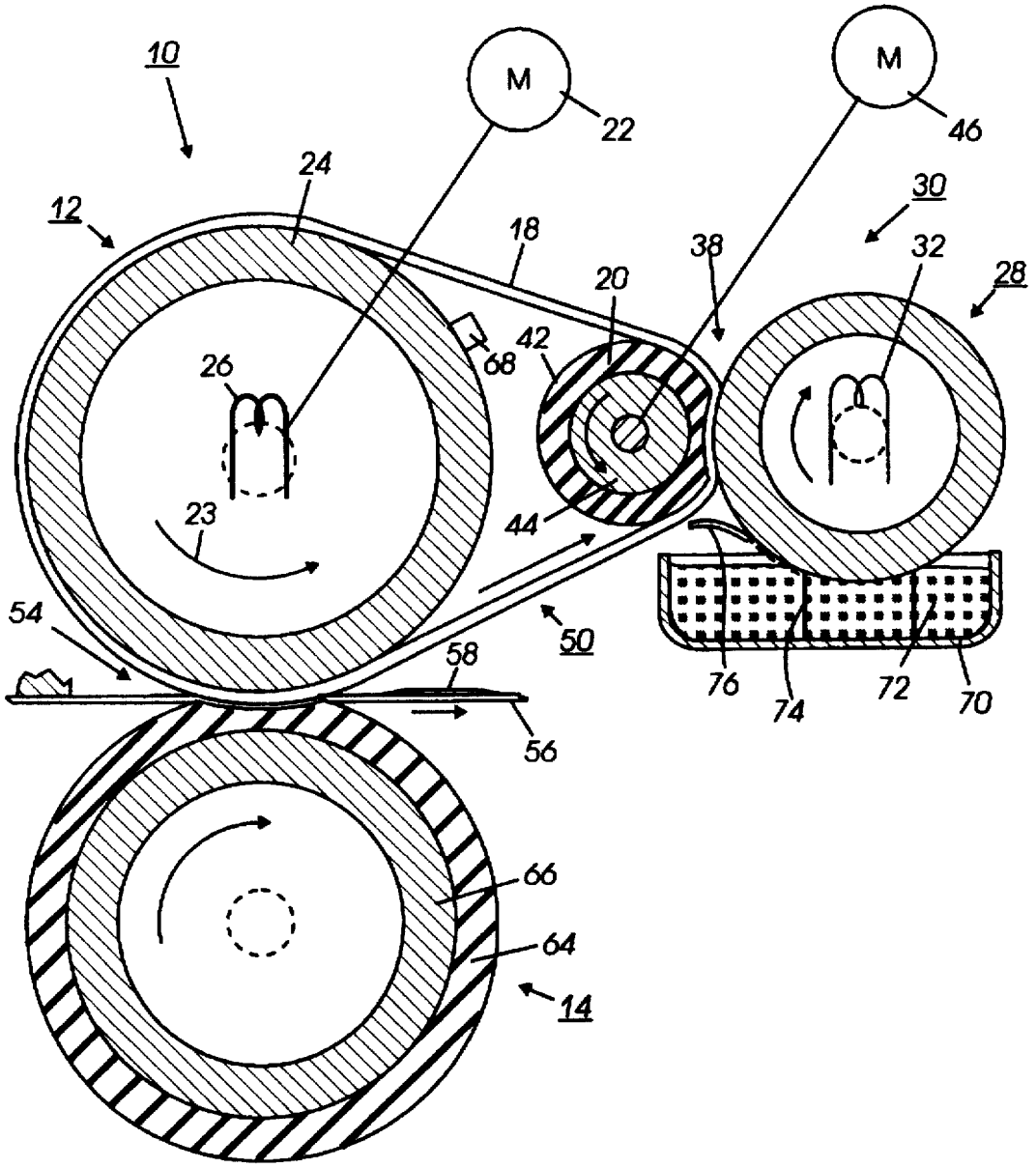
10
M
22
M
46
24
12
18
38
30
32
28
20
42
68
26
23
44
54
50
58
76
74
72
70
56
66
64
14

SINGLE ROLL RAM SYSTEM

BACKGROUND OF THE INVENTION

This invention relates to a heat and pressure fuser apparatus for toner images and in particular to such an apparatus that is suitable for fusing color pictorial images created using toner particles.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip.

Roll fusers are known to be capable of fusing monochrome black toner images at very high (i.e. 135 cpm) speeds. However, roll fusers capable of fusing pictorial images at relatively high speeds are non existent. Currently, the highest speed pictorial color fuser commercially available is capable of fusing at a far less number of copies per minute (cpm) than 135 cpm.

One recent innovation in the area of fusing pictorial color images formed with color toner particles is described in U.S. Pat. No. 5,268,559 granted to Robert M Jacobs on Dec. 7, 1993. This patent discloses a belt fuser that is self-stripping. The belt and a pressure roll form a nip through which substrates carrying toner images pass with the toner images contacting the belt. The belt is entrained about a plurality of non-deformable rollers for movement in an endless path. One of the non-deformable rollers which is a drive roller for effecting belt movement drives the belt at a faster speed than the speed at which the belt is driven through the aforementioned nip. Thus, the belt is over-driven at that point for causing a post-nip extent of the belt to stretch for effecting separation of the substrates from the belt. However, stretching of the belt is somewhat limited due to the absence of pressure loading of the drive roller with a metering roller.

At high process speeds, whether using roll fusers or belt fusers it is necessary to apply a release agent material such as silicone oil to the surface that contacts the toner images. A device for applying the silicone oil to the that surface comprises a Release Agent Management (RAM) system comprising a supply of silicone oil and a combination donor/metering roll arrangement for conveying the silicone oil to the surface contacting the toner images. One such a RAM system is disclosed in U.S. Pat. No. 4,214,549 issued on Jul. 29, 1980 to Rabin Moser. This patent illustrates a heat and pressure roll fusing apparatus for fixing toner images to copy substrates, the toner comprising a thermoplastic resin. The apparatus includes an internally heated, fuser roll cooperating with a backup or pressure roll to form a nip through which the copy substrates pass with the images contacting the heated roll. The pressure roll is the softer of the two rolls, therefore, the nip is formed by the harder fuser roll indenting the softer pressure roll. The heated fuser roll is characterized by an outer layer or surface which by way of example is fabricated from a very thin silicon rubber or Viton material to which a low viscosity polymeric release fluid is applied. Release fluid is contained in a sump from which it is dispensed by means of a metering roll and a donor roll, the former of which contacts the release fluid in the sump and the latter of which contacts the surface of the heated fuser roll. The donor roll is provided with an outer elastomeric layer which is deformable by both the heated fuser roll and the metering roll. Thus, the driven fuser roll structure imparts rotational movement to the donor roll which, in turn, effects rotational movement of the metering roll through its contact therewith.

In patent application Ser. No. 08/673547, there is disclosed a RAM system wherein the donor roll of the donor/metering combination of RAM system of the '549 patent is replaced by the non-deformable metering roll. This was made possible because the heated fuser roll which it contacts has a deformable outer layer. Thus the hip required in these type of systems for enabling the driving of one roll structure by another is provide when the metering roll and deformable fuser roll are pressure engaged. Both this application and the '549 patent use one hard roll and one deformable roll for effecting rotation of a non-driven roll.

Following is a discussion of other prior art, incorporated herein by reference, which may bear on the patentability of the present invention. In addition to possibly having some relevance to the question of patentability, these references, together with the detailed description to follow, should provide a better understanding and appreciation of the present invention.

U.S. Pat. No. 4,770,116 issued Sep. 13, 1988 to Rabin Moser discloses a heat and pressure roll fusing apparatus for fixing toner images to copy substrates, the toner comprising a thermoplastic resin. The apparatus includes an internally heated fuser roll cooperating with an unheated bare metal backup or pressure roll to form a nip through which the copy substrates pass with the images contacting the heated roll. The heated fuser roll is characterized by a conformable outer layer or surface which by way of example is fabricated from a silicone rubber or "Viton" material to which a low viscosity polymeric release fluid is applied. Release fluid is contained in a sump and the pressure roll is partially immersed in the fluid. Thus, the release fluid is applied to the surface of the internally heated fuser roll via the bare metal pressure roll. The roll structures are such as to provide maximum area of contact in the nip, while minimizing the area of contact between the pressure roll and the copy substrates. The area of contact between a typical copy substrate and a hard or non-conformable roll such as the pressure roll is very small (i.e. less than 10%). On the other hand, the area of contact between a conformable fuser roll and such a pressure roll is nearly 100%. Accordingly, the fuser oil can be continuously applied to the pressure roll which will result in the desired amount of oil being presented to the fuser roll and a minimum amount of oil being deposited on the backside of the copy substrate U.S. Pat. No. 3,716,221 issued on Feb. 13, 1973 to Gorka et al discloses a heat and pressure fuser roll wherein the heated fuser roller includes a fusing roller having a resilient fusing blanket supported on the periphery thereof and heating means to heat the fusing blanket to a temperature sufficient to fuse the particulate material on a copy sheet. A backup roller is urged toward engagement with the deformable fusing blanket to press the receptor sheet carrying the particulate material into contact with the fusing roller. The fuser roller is coated with an off-set preventing liquid which is applied thereto from the backup roller at predetermined intervals during operation of the device. The off-set preventing liquid is applied to the backup roller via a wick, one end of which is immersed in a quantity of the liquid which is contained in a receptacle. The application of the liquid to the backup roller is controlled such that it is applied once every eleventh revolution of the fuser roller. In other words ten copy sheets are passed through the fuser and then the fuser and backup rollers are rotated an eleventh time without a copy sheet passing therebetween at which time the liquid is applied to the fuser roller via the wick and backup roller.

U.S. Pat. No. 4,397,936 granted to Sakata et al on Aug. 9, 1983 discloses a fixing apparatus for use in a copying machine and the like which includes upper and lower fining rollers suitably heated and contacting each other for simultaneous rotation to define a path between them through which copy paper sheets to be fixed pass, an applicator member for applying offset prevention solution to one of the fixing rollers, and a smoothing roller with oil absorbing property arranged to contact under pressure the surface of the one of the fixing rollers applied with the offset prevention solution for simultaneous rotation. The smoothing roller is arranged to function to absorb excessive offset prevention solution applied onto the surface of the one of the fixing rollers and also to uniformly distribute the offset prevention solution adhering to the surface of the one of the fixing rollers.

Compared to wicks, a donor roll RAM provides a significant oil uniformity microscopically on a copy and also to copies during long runs. One major disadvantage of a donor roll RAM system is it creates a major thermal load on the fuser during standby as well as during run. When a wick is used to apply the liquid to the pressure roller, as in the case of the '221 patent, the liquid is applied as drops or droplets rather than in a thin layer.

DESCRIPTION OF THE DRAWINGS

The FIGURE is a side elevational schematic view of a heat and pressure fuser according to the present invention.

BRIEF SUMMARY OF THE INVENTION

Briefly, the present invention provides for fusing of pictorial color toner images at relatively high speeds.

The fusing of pictorial colored images using xerographic imaging requires extended dwell time at fusing temperatures and fuser rubber strain. The extended dwell ensures complete toner flow while the rubber strain ensures release and stripping.

One of the most difficult problems in the development of a pictorial color fuser is that of achieving stripping.

In heat and pressure roll fusers, stripping of the image substrate is effected using stripping devices such as fingers or blades in conjunction with hard surfaced fuser rolls or by constructing the fuser roll member contacting the toner images such that the system is self-stripping. In the latter case, the fuser roll is usually fabricated with a relatively thick deformable material such as silicone rubber supported on a rigid core.

Belt fusers, in particular, one that is heated from the backside, are constructed using relatively thin elastomeric material. Thin belt fusers are less compatible with devices such as stripper fingers or blades and they do not lend themselves to self-stripping.

The present invention provides a belt fuser which is self-stripping. To this end, a belt comprising the member contacting the toner images to be fixed is entrained about a plurality of rolls including a drive roll for imparting movement to the belt and a hard or non-deformable fuser roll. A deformable pressure roll cooperates with the belt to form a nip through which copy substrates pass with the toner images thereon contacting the heated belt, positioned between the fuser and pressure rolls.

The drive roll is similar in construction to the donor roll of the '549 patent discussed above, in that, it comprises an outer deformable layer. The drive roller is pressure engaged with a hard surfaced metering roller similar in construction to the metering roller of the '549 patent. The pressure loading of these two rollers enables stripping of the substrate carrying the toner images when the drive roller overdrives the belt in a post-fuser-nip extent of the belt. The belt is stretched in the post-fuser-nip area thereby effecting stripping of the substrate from the belt.

The metering roller forms part of a RAM system wherein it is the sole means of conveying release agent material such as silicone oil from a sump containing the oil to the surface of the fusing belt.

The serf-stripping action of the fuser of the present invention is similar to the phenomena that takes place when scotch tape is adhered to a rubber band and then rubber band is stretched. The tape will pop off of the rubber band. In this fuser, the tape corresponds to the paper with molten toner and the rubber band is the elastic belt that is stretched. The stretching of the belt at the nip exit ensures that the toner will not adhere to the fuser belt.

DETAILED DESCRIPTION OF THE DRAWING

The FIGURE is a side elevational schematic view of a heat and pressure fuser incorporating the present invention.

PREFERRED EMBODIMENT OF THE INVENTION

As illustrated in the FIGURE, the invention is directed to a heat and pressure fuser apparatus 10 including a heated fuser roll structure 12 and a pressure roll structure 14.

A fuser belt 18 is entrained about the heated fuser roll structure 12 and a belt support roller 20. A motor 22 and an associated drive train (not shown) are provided for imparting rotation to the fuser roll structure 12 in the direction of the arrow 23.

The fuser roll structure 12 is the primary source of thermal energy for elevating temperature of the surface of the belt 18 to fusing temperature. To this end, it comprises a rigid core 24 and a quartz lamp heater structure 26.

A metering roller 28 forming part of a Release Agent Management (RAM) system 30 cooperates, through the belt 18, with the support roller 20 to form a nip 38 therebetween. Thus, the belt support also serves as a backup roller for the metering roll 28. The metering roller is internally heated by means of a heater 32. The heater 32 constitutes a secondary source of thermal energy for heating the belt 18.

The support and metering rollers correspond in construction to the donor/metering roll pair disclosed in the '549 patent discussed above. The metering roller 28 is the sole means for conveying release agent material to the surface of the belt 18 in a manner to be described hereinafter. The belt 18 and donor/backup roller 20 possess high friction properties to enable driving of the metering roller thereby. To this end, the belt 18 is fabricated from silicone rubber and the roller 20 comprises a relatively thick silicone rubber layer 42 adhered to a rigid metal core member 44. A drive motor 46 effects rotation of the roller 20. The drive motor 46 serves to drive the belt 18 at speed about 5% faster than the belt is driven by the fuser roll and fuser roll motor 22 thereby effecting overdriving of the belt in the post-fuser-nip area designated by reference character 50.

A conventional cam and cam follower arrangement (not shown) serve to effect pressure engagement of the roll 20 with the metering roll 28 which creates the nip 38 therebetween. Loading is effected when the cam follower is urged in the counter clockwise direction about its pivot as indicated in the Figure.

The heated fuser roll structure 12 cooperates, through the belt 18, with the backup or pressure roll structure 14 to form a nip 54 through which a copy substrate 56 passes with toner images 58 formed thereon in a well known manner. The toner images 58 contact the heated belt 18 while a loading force is applied between the fuser roll structure 12 and the pressure roll structure 14 in a well known manner to create pressure therebetween resulting in the deformation of a relatively thick layer 64 adhered to a rigid core 66 to thereby form the nip 54.

A contact temperature sensor 68 is provided for sensing the surface temperature of the roll structure 12 and in conjunction with conventional circuitry (not shown) maintains the surface temperature to a predetermined value, for example, on the order of 375°–400° F.

The temperature sensor 68 controls the On/Off duration of the radiant quartz heater 26 disposed internally of the rigid core 24. When suitably energized via the aforementioned circuitry, the heating element radiates heat to the rigid core 24 which is then conducted to the outer surface thereof.

The layer 64 of the nonheated pressure roller 14 may be fabricated, for example, from any suitable material such as a terpolymer elastomer such as ethylene-propylene diene monomer which is based on stereosperific linear terpolymers of ethylene, propylene and small amounts of non-conjugated diene which is commonly referred to as EPDM which layer carries a thin overcoat of PFA. Due to the relative constructions of the heated fuser roll and pressure or backup roll structures, the layer 64 of the pressure roll structure is deformed by the harder, heated fuser roll structure when the required pressure is applied therebetween in a well known manner.

As noted above, the RAM system 30 comprises the metering roll 28. Additionally, it comprises a sump 70, a supply of silicone oil 72, a wick 74 and a metering blade 76. The metering roll 30 contacts the wick and the silicone oil contained in the sump. When rotated via the belt 18 and the roller 42 the metering roll 28 conveys silicone oil from the sump to the surface of the belt in at the nip area 38. The blade 76 serves to meter the oil to an even layer on the surface of the metering roll.

The wick 74 is fully immersed in the release agent material 36 and contacts the surface of the metering roll 28. The purpose of the wick is to provide an air seal which disturbs the air layer formed at the surface of the metering roll 42 during rotation thereof. Absent the wick, the air layer would be coextensive with the surface of the metering roll immersed in the release agent thereby precluding contact between the metering roll and the release agent.

The metering blade 76 preferably fabricated from Viton is $\frac{3}{4}\times\frac{1}{8}$ in cross section and has a length coextensive with the metering roll. The edge of the blade contacting the metering roll has a radius of 0.001–0.010 inch. The blade functions to meter the release agent picked up by the metering roll 28 to a predetermined thickness, such thickness being of such a magnitude as to result in several microliters of release agent consumption per copy.

The metering roll 28 preferably comprises a wear resistant metal, steel-surfaced, roll having a 4–32 AA finish. As mentioned above, the metering roll 28 is supported for rotation, such rotation being derived by means of the positively driven drive roller 20 and the belt 18. In order to effect rotation of the metering roll 28 at the desired speed a load is effected between it and the drive roll 20 such that the deformable layer 42 is deformed thereby forming the nip 38. A suitable nip length is 0.10 inch. The pressure loading between these two rolls allows for overdriving of the belt in the area 50 for effecting substrate stripping.

What is claimed is:

1. A contact fuser apparatus having a heated roll structure and a pressure roll structure with a nip therebetween through which copy substrates carrying toner images pass, said apparatus comprising:

a heated fuser member;

a fuser belt entrained about said heated fuser roll and a support member, said support member comprising a deformable outer layer;

a pressure member positioned for pressure engagement with said fuser belt;

a rotatably supported hard surfaced metering roll structure contacting said heated fuser belt for applying release agent material thereto said metering roll structure and said support member being supported such that they form a nip therebetween;

means for effecting pressure engagement between said support member and said metering roll to thereby deform said outer layer;

means for effecting movement of said heated fuser member at a first predetermined speed and, in turn, said fuser belt, rotation of said metering roll structure being effected by virtue of its contact with said heated fuser belt and said support member; and means for effecting movement of said support member at a second predetermined speed greater than said first predetermined speed.

2. The apparatus according to claim 1 wherein said fuser, pressure and support members comprise roll structures.

3. The apparatus according to claim 2 including a supply of release agent material, said supply being positioned such that it is contacted by said metering roll structure whereby release agent material can be conveyed to said fuser belt.

4. The apparatus according to claim 3 wherein said metering roll is the sole means for conveying silicone oil from said supply to said layer.

5. The apparatus according to claim 4 wherein said deformable layer comprises silicone rubber.

6. The apparatus according to claim 5 wherein said fuser belt comprises an adhesive material.

7. The apparatus according to claim 2 wherein one of said nip forming members is heated.

8. The apparatus according to claim 7 wherein said metering roll structure is heated.

9. The apparatus according to claim 8 wherein said metering roll structure is internally heated.

* * * * *